US005338053A

United States Patent [19]

Hauglin

[11] Patent Number: 5,338,053

[45] Date of Patent: Aug. 16, 1994

[54] CROSS-COUNTRY OR TOURING SKI BINDING FOR CROSS-COUNTRY SKI BOOTS

[75] Inventor: Bernt-Otto Hauglin, Royken, Norway

[73] Assignee: Rottefella A/S, Norway

[21] Appl. No.: 4,983

[22] Filed: Jan. 15, 1993

[30] Foreign Application Priority Data

Jan. 16, 1992 [DE] Fed. Rep. of Germany ... 9200453[U]

[51] Int. Cl.[5] ..... A63C 9/086

[52] U.S. Cl. ..... 280/615

[58] Field of Search ..... 280/611, 614, 615, 633, 280/634

[56] References Cited

U.S. PATENT DOCUMENTS

| | | | |
|---|---|---|---|
| 5,190,309 | 3/1993 | Spitaler et al. | 280/615 |
| 5,190,310 | 3/1993 | Hauglin et al. | 280/615 |
| 5,213,359 | 5/1993 | Girard | 280/615 |
| 5,224,730 | 7/1993 | Provence et al. | 280/615 |

FOREIGN PATENT DOCUMENTS

| | | |
|---|---|---|
| 8907843 | 10/1989 | Fed. Rep. of Germany . |
| 3912019 | 10/1990 | Fed. Rep. of Germany . |
| 9011806 | 10/1990 | Fed. Rep. of Germany . |
| 4109009 | 12/1991 | Fed. Rep. of Germany . |
| 4112979 | 10/1992 | Fed. Rep. of Germany . |
| 2664174 | 7/1990 | France . |
| 170836 | 4/1989 | Norway . |

*Primary Examiner*—Richard M. Camby
*Attorney, Agent, or Firm*—Andrus, Sceales, Starke & Sawall

[57] ABSTRACT

A binding for cross-country or touring skis for use in combination with ski boots engagement elements for receiving complementary engagement elements provided on the boots. The engagement elements of the binding are disposed within a binding housing (14) establishing a pivot-type connection. A pivot (18) extends crosswise to the longitudinal extension of the boot. The engagement elements of the binding include a retaining hook (26) engaging behind the pivot (18), cooperating to constitute a hinge joint. The hook is movable between a closing position and a releasing position, and a flexor (80) is provided on the binding for resiliently returning the boot from a raised position to a position parallel to the ski. The sole of the boot includes a pivot (18) which is supported on the side of the binding against a separate supporting bearing made of metal or the like. The supporting bearing is disposed inside an open-topped recess (56) in the binding housing (14), with the recess extending transversely to the longitudinal extension of the ski.

12 Claims, 4 Drawing Sheets

CROSS-COUNTRY OR TOURING SKI BINDING FOR CROSS-COUNTRY SKI BOOTS

BACKGROUND OF THE INVENTION

The present invention is directed to a cross-country or touring ski binding.

A cross-country or touring ski binding of the above-mentioned kind is described in WO 90/11806. This cross-country or touring ski binding is chiefly distinguished by its light-weight structure, ruggedness, good guiding properties as well as simple and safe operation. At the same time, this cross-country or touring ski binding ensures an ergonomic flow of motion, in particular a flow of motion without any excessive strain on the toes of the cross-country skier as he pursues his sport. Accordingly, the binding has been widely accepted by consumers. However, it has been found in practice that the components used for the transmission of power, which are predominantly made of light-weight plastic material or the like, are not very wear-resistant in the vicinity of the pivot-like connection between this cross-country or touring ski binding on the one hand and the ski boot on the other hand when they are subjected to great loads, especially when they are in permanent use. Moreover, it may happen that snow, ice or the like penetrates in the vicinity of the partly exposed pivot-like connection whereby entry into or exit from the cross-country or touring ski binding is made difficult.

SUMMARY OF THE INVENTION

It is therefore the objective of the present invention to improve the known cross-country or touring ski binding to the effect that high wear resistance and improved smooth working upon entry and exit are achieved while the light-weight structure as well as the ruggedness, good guiding properties, simple and safe operation and ergonomically favourable design are retained.

In accordance with the invention the specified objective is achieved by the characterizing features wherein the ski binding for a cross-country and a touring ski includes a binding housing of a low wear resistant characteristic, such as plastic, and includes a recess with a separate wear resistant support unit such as a metal mounted therein and forming the ski mounted part of the ski binding for receiving and pivotally supporting a ski boot.

In this way it is possible to obtain a cross-country or touring ski binding for cross-country ski boots which has numerous components of light-weight plastic or similar material while the components used for the transmission of power, viz. the engagement elements for making the pivot-like connection between the cross-country or touring ski binding on the one hand and the ski boot on the other hand, are made of metal or similar resistant material. Hence, the weight of the cross-country skier which is introduced via the ski boot bears against a metallic supporting bearing or the like of the cross-country or touring ski binding which bearing is capable of permanently transmitting high loads without exhibiting any wear and tear. Moreover, the design in accordance with the present invention serves to improve smooth working of the cross-country or touring ski binding as the cross-country skier enters the binding or exits therefrom.

Features important for high wear resistance of the cross-country or touring ski binding are disclosed. A sole-integrated pivot unit, which is made of metal or similar wear resistant material, is accommodated by a supporting bearing which is likewise made of metal or similar resistant material. Any wear of the pivot-like connection between the ski boot and the cross-country or touring ski binding is thereby prevented. This holds all the more as the supporting bearing of the cross-country or touring ski binding has a pivotal bearing region which receives a sole-integrated round member, which is rounded in accordance with the diameter of such round member. Therefore the sole-integrated pivot applies at most a surface load to the separate supporting bearing so that there are only small frictional forces which act during the continual rolling motion of the ski boot while cross-country skiing and hence upon rotation of the sole-integrated pivot within the separate supporting bearing. This is in turn favourable to the smooth working of the cross-country or touring ski binding as a whole. Due to the preferred use of flat metal parts for the separate supporting bearing the light-weight structure of the entire cross-country or touring ski binding is retained.

Furthermore, other features particularly advantageous includes a resilient element, preferably a torsion spring, helical compression spring or the like, supporting a swivel arm for connecting a retaining hook to the actuating lever of the binding to provide an extremely simple and compact structure which permits the retaining hook for the sole-integrated pivot to move from the closing position to the releasing position and vice versa. Also, the structural separation of the resilient element and the supporting bearing for accommodating the sole-integrated pivot makes it possible to obtain a particularly operationally safe structure because the closing or releasing function of the resilient element and the supporting function of the supporting bearing for the sole-integrated pivot are separated from each other. Hence, even in case of an oblique load acting on the supporting bearing the resilient element will remain unloaded by the sole-integrated pivot.

Furthermore, other features offer additional advantages for improved smooth working of the cross-country or touring ski binding as the cross-country skier enters the binding and particularly as he exits therefrom after having pursued his sport. In one feature, a guide element which is provided for guiding the retaining hook in a longitudinal direction of the ski including a roof-like cover both for a U-shaped bracket mounted to the ski and for an open-topped recess which extends crosswise to the longitudinal extension of the ski and approximately parallel to the top surface of the ski body, to receive the supporting bearing for the sole-integrated pivot. The roof-like cover prevents clogging of the pivot by snow, ice or the like. Also, the reciprocating motion of the retaining hook and the guide element, which covers the former somewhat like a roof, is not impeded by snow, ice or the like because the land or the like of the guide element and the guide groove, guide slot or the like cooperating therewith come into operative mutual engagement within the binding housing so that they are shielded from snow, ice or the like.

Also, in accordance with another feature the binding housing includes at least one and preferably two guide fins which extend from the flexor towards the rearward end of the ski. The boot sole includes complementary guide grooves on the underside of its sole. The guide fins are provided with at least one and in particular with several equidistantly spaced, open-topped recesses which extend crosswise to the longitudinal extension of the ski. Such a configuration of the binding housing offers the additional advantage of a saving of material and hence of a reduction in weight of the cross-country or touring ski binding as a whole without having to accept reduced stiffness. Also, such a configuration of the binding housing permits the discharge of snow, ice or the like which might collect between the two guide fins.

Finally, the separate support bearing is formed of non-corroding material such as stainless steel or aluminum to which it increases the wear resistance of the cross-country or touring ski binding according to the present invention.

BRIEF DESCRIPTION OF THE DRAWINGS

Further features, advantages and details of the present invention will be apparent from the following description of some preferred embodiments thereof with reference to the drawings, in which.

Figure 1:
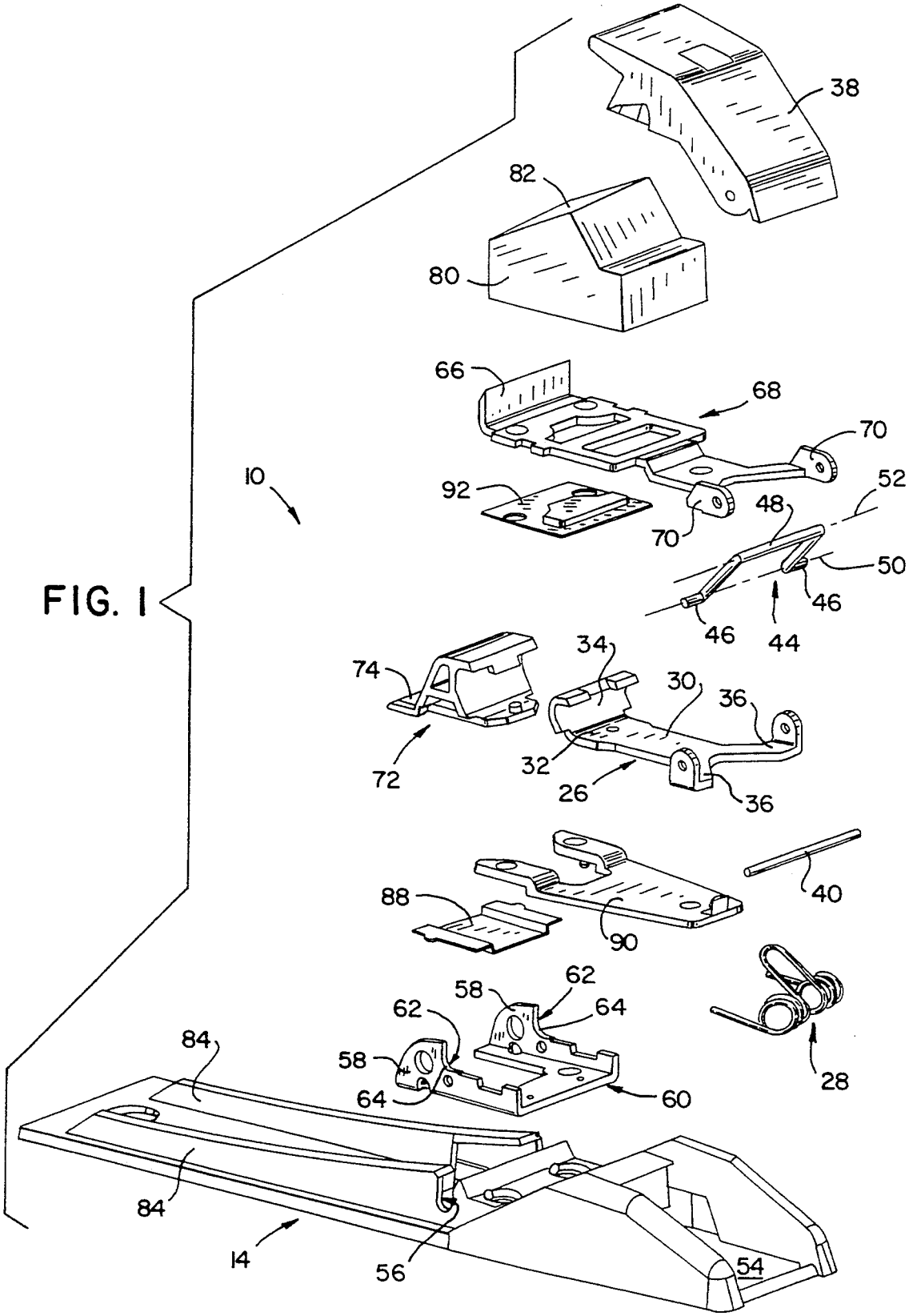
FIG. 1 is an exploded perspective view of a cross-country or touring ski binding designed in accordance with the invention.
Figure 2A:
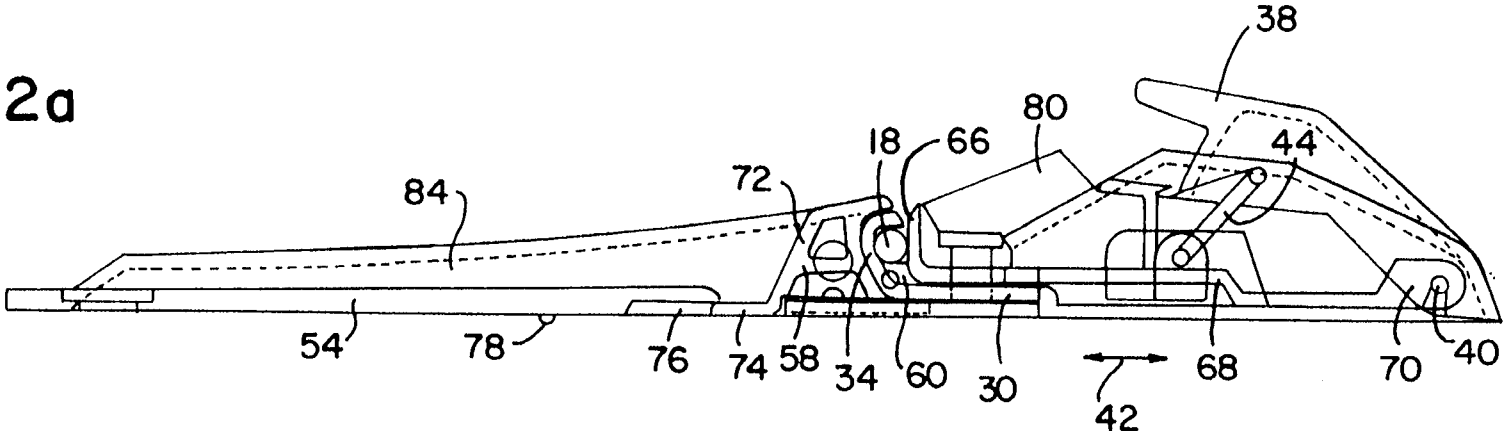
Figure 2B:
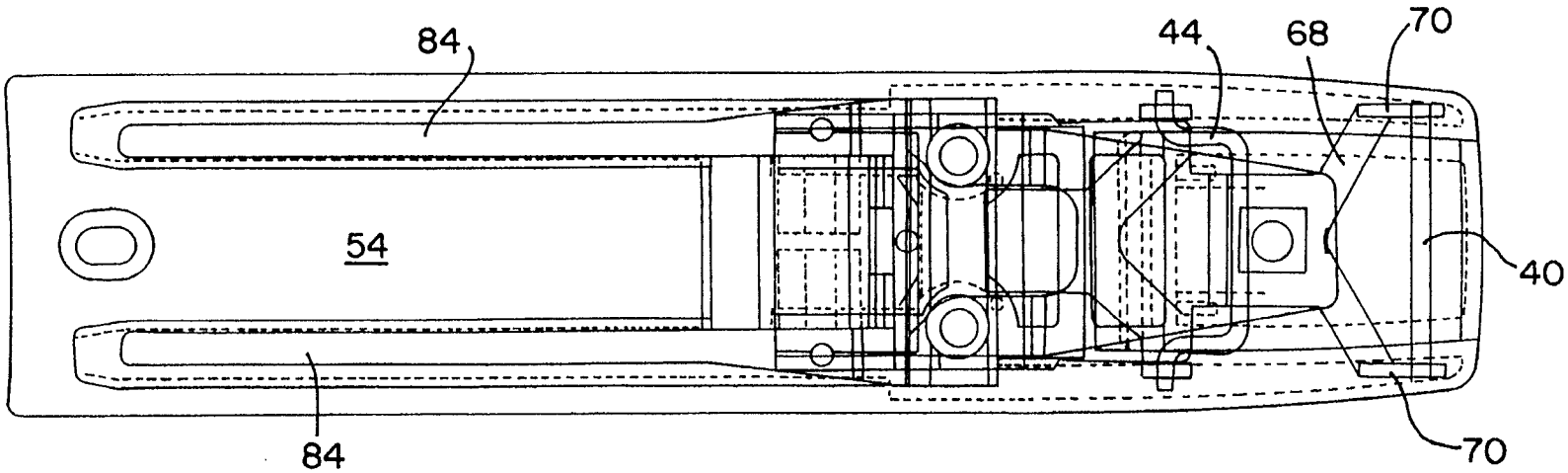
Figure 3A:
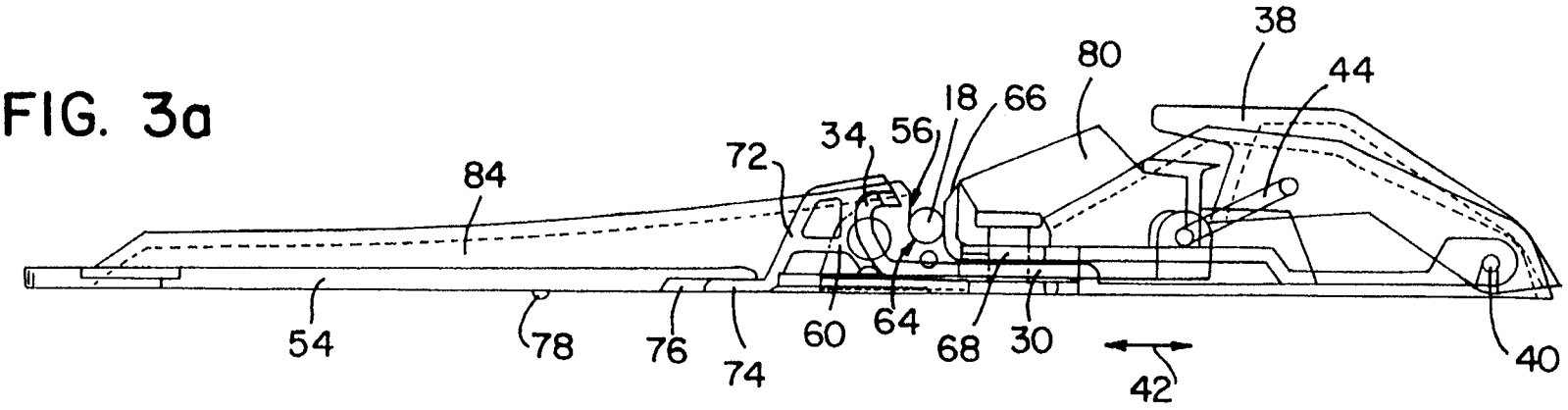
Figure 3B:
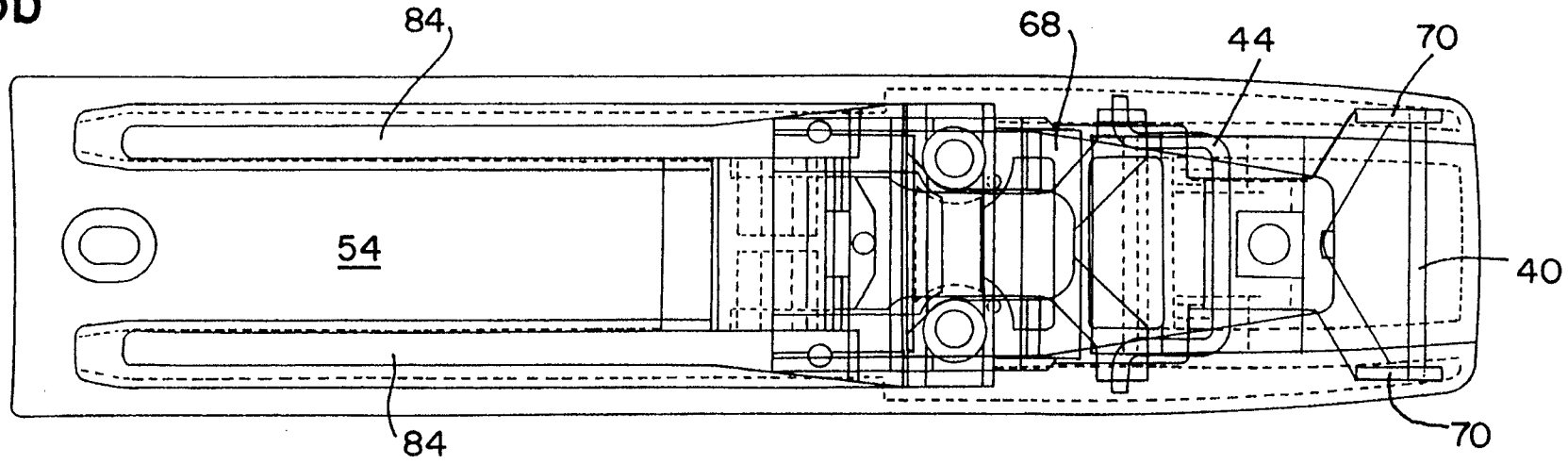
Figure 4:
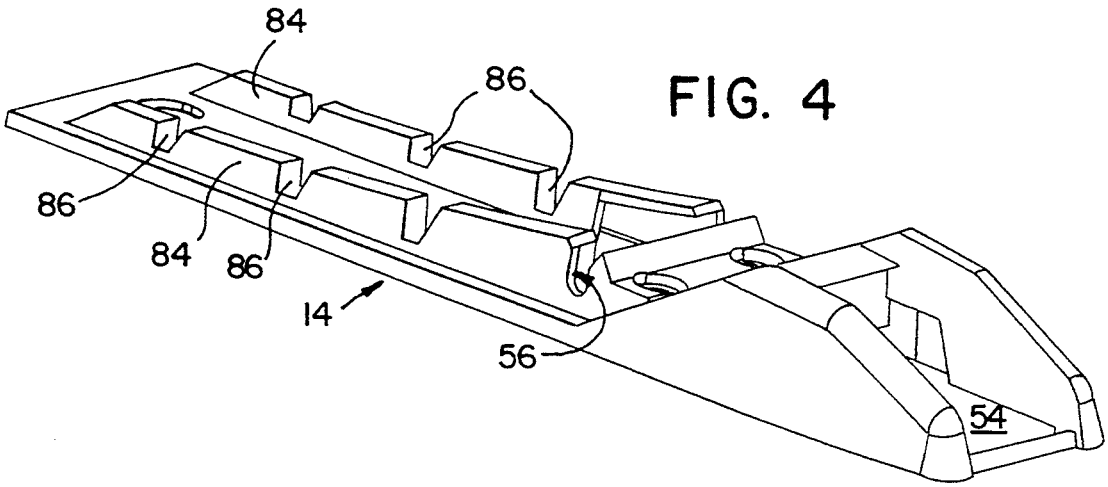
Figure 5:
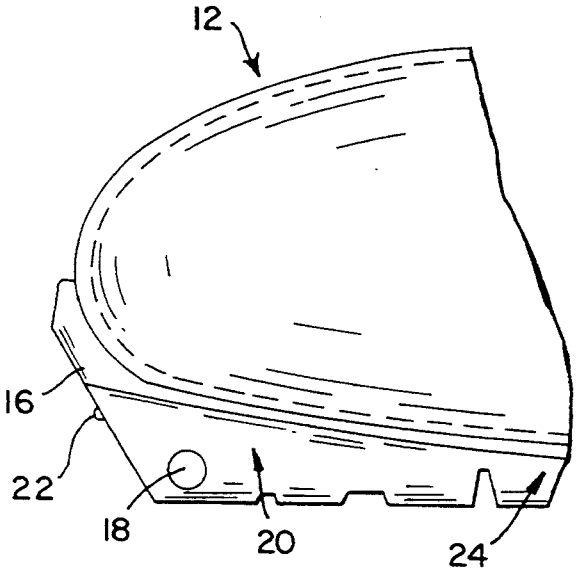
Figure 6:
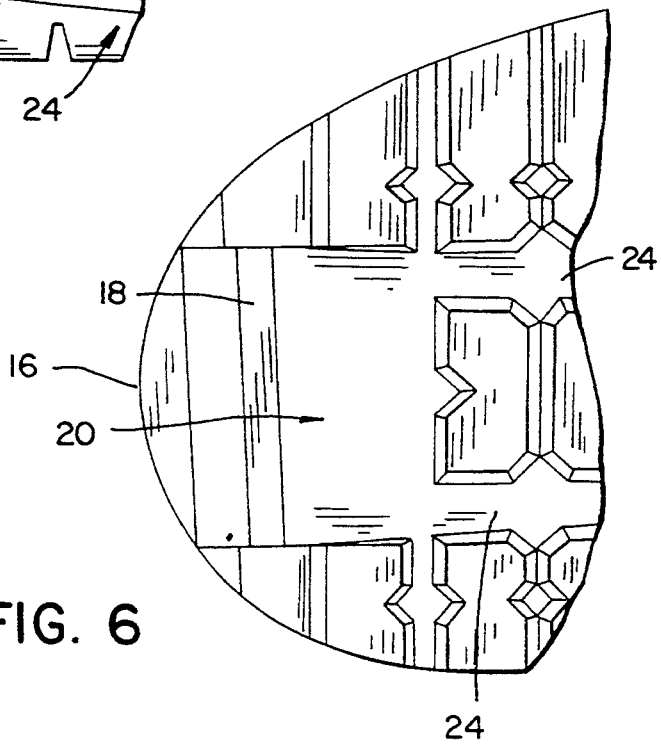

FIGS. *2a* and *2b* are an assembled cross-country or touring ski binding according to FIG. 1 as a schematic longitudinal section and as a plan view, respectively, in the closed position;

FIGS. *3a* and *3b* are an assembled cross-country or touring ski binding according to FIG. 1 also as a schematic longitudinal section and as a plan view, respectively, but in the open or release position;

FIG. 4 is a perspective view of another embodiment of a binding housing of the cross-country or touring ski binding according to the invention as shown in FIG. 1;

FIG. 5 is a longitudinal sectional view of the forward portion of a ski boot adapted to the cross-country or touring ski binding shown in FIGS. 1 to 3; and FIG. 6 is a plan view showing the sole of the front portion of the ski boot of FIG. 5.

DESCRIPTION OF THE ILLUSTRATION EMBODIMENT

The cross-country or touring ski binding 10 illustrated in FIGS. 1 to 3 for cross-country ski boots 12 illustrated in FIGS. 5 and 6 is mounted in a manner known per se on the upper surface of a ski body (not illustrated) for instance by screws. In order to provide a pivot-like connection the binding housing 14, which is made of plastic or similar material, has provided therein engagement elements of the binding 10 and complementary engagement elements of the ski boots 12 respectively provided on the sole forward end 16 for engagement with the former elements.

The engagement elements shown in FIGS. 5 and 6, which are integrated in the sole, comprise a pivot 18 extending crosswise to the longitudinal direction of the boot and approximately parallel to the sole surface. The pivot 18 extends within a groove-like recess 20 on the underside of the sole end 16 of the sole of the ski boot 12 at a distance from the bottom of the groove-like recess 20 and at a distance from the sole forward end 16 or a forward bearing surface 22 at the sole forward end 16. Guide grooves 24 are directly contiguous with the recess 20 which is formed on the underside of the sole end 16 of the sole of the ski boot 12.

The complementary engagement elements of the binding 10 comprise a retaining hook 26 for engagement behind the pivot 18 to form a hinge joint therewith, said retaining hook adapted to be moved from a closed position shown in FIG. 2 to an open or releasing position shown in FIG. 3, and vice versa. In this connection the retaining hook 26 is movable preferentially against the action of a resilient element, in particular of a torsion spring 28, a helical compression spring or the like, to its releasing position illustrated in FIG. 3. Said resilient element or said torsional compression spring 28 also causes the automatic movement of the retaining hook 26 towards its closed position illustrated in FIG. 3. The retaining hook 26 shown in FIGS. 1 to 3 is constituted by a flat element 30 mounted for reciprocating movement within the binding housing 14. The one end 32 thereof, i.e. the rear end or the end facing the ski end, has been given the shape of a U-bracket 34 which is open towards the ski tip and in the closed position engages behind the sole-integrated pivot 18. The other end 36 thereof, i.e. the front end or the end remote from the ski end, is connected to an actuating lever 38, which is pivotally mounted within the binding housing 14 via a bolt 40 or the like, such that the pivoting movement of the actuating lever 38 may be converted to a translational reciprocating movement of the retaining hook 26 as illustrated by the double arrow 42 in FIGS. 2 and 3.

The retaining hook 26 is connected with the actuating lever 38 by means of a swivel arm 44 or the like. The swivel arm 44 is coupled with the retaining hook 26 via the two ends 46 thereof and is coupled with the actuating lever 38 by means of a central web 48 which interconnects the two ends 46. The coupling axes 50, 52 of the swivel arm 44 are disposed to extend parallel to each other (see in particular FIG. 1). The actuating lever 38 is likewise urged by a resilient element, in particular the torsion spring 28, helical compression spring or the like, towards a position in which the retaining hook 26 is in the closed position where it engages behind the sole-integrated pivot 18. Instead of the torsion spring 28, the helical compression spring or the like which is placed between the actuating lever 38 and the bottom 54 of the binding housing 14, it is also possible to use a different elastic block for instance of rubber material etc. as the resilient element.

The complementary engagement elements of the binding 10 also comprise a separate supporting bearing of metal or similar resistant material for supporting the sole-integrated pivot 18 on the side of the binding. As will be apparent from FIGS. 2 and 3, the supporting bearing is disposed within an open-topped recess 56 in the binding housing 14, said recess extending crosswise to the longitudinal extension of the ski and approximately parallel to the top surface of the ski body (not illustrated). On the one hand, the supporting bearing is composed of two upright plates 58 of a U-shaped flat element 60, said plates being spaced from each other crosswise to the longitudinal direction of the ski and each having an L-shaped cut-out 62, and on the other hand by a defining element which is associated with the above-mentioned cut-outs 62. The transition 64 between the two defining faces of the L-shaped cut-outs 62 has rounded shape to correspond to the diameter of the sole-integrated pivot 18. The defining element which is associated with the L-shaped cut-outs 62 of the two plates 58 of the flat element 60 is a bearing plate 66 according to FIGS. 1 to 3 which extends crosswise to the longitudinal direction of the ski and substantially normal to the top surface of the non-illustrated ski body or the bottom 54 of the binding housing 14, respectively. Preferentially, the bearing plate 66 is part of a flat element 68 which is fixed to the binding housing 14 and the front end 70 of which facing towards the ski tip is also mounted via the bolt 40 on the binding housing 14.

Therefore, the sole-integrated pivot 18 is supported rearwardly and downwardly, i.e. towards the ski end and towards the top surface of the non-illustrated ski body, by the L-shaped cut-outs 62 of the two plates 58 of the U-shaped flat element 60 and is supported forwardly, i.e. towards the ski tip, against the bearing plate 66 which is associated with the aforementioned cut-outs 62.

As will be further apparent from FIGS. 1 to 3 the retaining hook 26 is connected at its one end 32, i.e. the rear end or the end facing the ski end, with a guide element 72 which covers the U-bracket 34 like a roof and at the same time serves to guide the retaining hook 26 in longitudinal direction of the ski. Together with the retaining hook 26, the guide element 72 is mounted within the binding housing 14 for reciprocating movement. The contour of the guide element 72 in the closed position is matched with the configuration of the binding housing 14. The guide element 72 is provided with a land 74 or the like which extends approximately as a continuation of the flat element 30 of the retaining hook 26 towards the ski end, said land engaging beneath the binding housing 14 such that the reciprocating movement thereof cannot be affected by snow, ice or the like. As will be apparent from FIGS. 1 to 3, the land 74 or the like of the guide element is accommodated in a guide groove 76, a guide slot or the like in such a way that the land 74 or the like may be moved to and fro within the guide groove 76, guide slot or the like. As shown in FIGS. 1 to 3, the guide groove 76, guide slot or the like is formed in the vicinity of the bottom 54 of the binding housing 14, preferentially on the underside 78 thereof, so that any clogging of the guide groove 76, guide slot or the like by snow, ice or the like is prevented. The roof-like guide element 72 moreover corresponds with the recess 20 on the underside of the sole end 16 of the ski boot 12 such that during the rolling motion of the ski boot 12 while cross-country skiing the guide element 72 extends into the recess 20 so as not to impede said rolling motion. Due to the roof-like guide element 72 the retaining hook in the open or releasing and in the closed position and at least part of the recess 56 of the binding housing 14 for the sole-integrated pivot 18 are covered in the closed position. Thereby the entry of snow, ice or the like into the interior of the binding housing 14 is also safely prevented so that the binding 10 of the present invention works very smoothly when the cross-country skier enters the binding or exits therefrom.

As indicated in FIGS. 2*a* and 3*a*, the sole forward end has associated therewith an elastically deformable element, i.e. a flexor 80 for elastically returning the ski boot 12 from a raised position to a position approximately parallel to the ski. The ski boot 12 is supported by the flexor 80 through the inclined bearing face 22 (see FIG. 5) at the sole forward end 16 of the ski boot 12. The bearing face 22 will bear against a corresponding inclined face 82 of the flexor 80 already when the ski boot 12 is fully lowered onto the top surface of the ski body. In this way the flexor 80 will be effective from the very beginning as the ski boot 12 is swung up.

As will be particularly apparent from FIG. 1 the binding housing 14 is provided with at least one and preferentially two guide fins 84 which extend from the flexor in the direction towards the ski end and cooperate with the complementary guide grooves 24 on the underside of the sole of the ski boot 12. The guide grooves 84 are integral portions of the binding housing 14 made of plastic material. The height of the roof-like guide element 72 and of the guide fins 84 contiguous therewith initially decreases progressively—beginning from the flexor 80 in the direction of the ski end—and then remains approximately constant. Both in the direction of the ski and crosswise to the same, the contour of the roof-like guide element 72 and of the directly contiguous guide fins corresponds to the contour of the recess 20 and of the directly contiguous guide grooves 24 on the underside of the sole of the ski boot 12. In longitudinal direction of the ski the contour of the mentioned parts has a slight concave curvature, as will be particularly apparent from FIGS. 1 and 4. This curvature promotes the rolling motion of the sole of the ski boot 12 during cross-country skiing. In the embodiment of the binding housing 14 illustrated in FIG. 4 the guide fins are provided with at least one and particularly several equidistantly spaced, open-topped recesses 86 which extend crosswise to the longitudinal direction of the ski. The recesses 86 facilitate the manufacture of the binding housing 14 without any loss in stability. Also, any snow, ice or the like collected between the guide fins 84 may be discharged from the binding housing 14 through the recesses 86.

The flat element 30 which constitutes the retaining hook 26, the U-shaped flat element 60 formed with the two plates 58 each having an L-shaped cut-out 62, and the flat element 68 provided with the bearing plate 66 are all made of metal or similar resistant material, in particular of rustproof metal, preferentially of special steel or aluminium.

As will be apparent from FIG. 1, an embodiment of the cross-country or touring ski binding 10 according to the invention is assembled as follows: First, the flat element 60 is mounted in its proper position in the binding housing 14. Then, an angle insert 88 and an intermediate men%her 90 are placed on the flat element 60. The intermediate member 90 is followed by the flat element 30 including the retaining hook 26 to the U-bracket 34 of which the guide element 72 is mounted with the land 74 or the like engaging in the guide groove 76, guide slot or the like on the underside 78 of the bottom 54 of the binding housing 14. Then, the bearing plate 66 including the flat element 68 is mounted together with another intermediate member 92 onto which the flexor 80 is finally placed. The actuating lever 38 is coupled via a bolt 40 to the forward end of the binding housing 14. The bolt 40 also accommodates the torsion spring 28 and has the additional function of fixing the bearing plate 66 with the flat element 68 through the forward end 70 thereof, i.e. the end remote from the ski end. Finally, the swivel arm 44 is coupled with its two ends 46 to the forward end 36, i.e. the end directed towards the ski tip, whereas the swivel arm 44 is pivotally mounted on the actuating lever 38 via the central web 48. The two coupling axes 50, 52 of the swivel arm 44 extend within the flat element 30 and the actuating lever 38 in parallel relationship.

All of the features disclosed in the present application papers are claimed as being essential for the invention to the extent to which they are novel over the prior art either individually or in combination.

I claim:

1. A cross-country and touring ski binding for cross-country ski boots having a sole with a front end (16) with at least one sole integrated pivot member (18) extending crosswise to the longitudinal extension of the boot and approximately parallel to the sole surface adapted to be inserted in engagement with elements of the binding (10), said binding comprising a binding housing (14) of plastic material having a low wear resistant characteristic and having a pivot support unit for establishing a pivot-type connection with said pivot member (18), said pivot support unit includes a retaining hook (26) engaging the rearward side of said pivot member (18) and constituting a hinge joint therewith, said hook being movably mounted to said housing for movement between a closing position and releasing position, a resiliency deformable element (80) located for engaging the front end of the sole and resiliently urging the boot (12) from a raised position to a position approximately parallel to the ski, said binding housing having an open-topped recess (56) extending transversely to the longitudinal extension of the ski, said pivot support unit including a supporting bearing unit (60–68) formed of high wear resistant material secured within said recess to releasably receive said pivot member, said supporting bearing unit includes a U-shaped element (60) including first and second upright side plates (58) being spaced from each other crosswise to the ski, each of said side plates including an L-shaped cut-out portion (62) and a confining element (68) aligned with said cutout portions (62) and operable to secure said pivot member (18).

2. The binding of claim 1, wherein each of said L-shaped cut-outs (62) includes first and second perpendicularly related edges, said edges being connected by a rounded edge (64) corresponding to and mating with the sole-integrated pivot member (18).

3. The binding of claim 1, wherein said confining element (68) includes a pivot supporting plate (66) connected to a flat element fixed to said binding housing (14), said flat element extending crosswise to the longitudinal extension of the ski.

4. The binding of claim 1, wherein said sole-integrated pivot member (18) is rearwardly and downwardly supported by said L-shaped cut-outs (62) of said two side plates (58) of said U-shaped flat element (60) while said sporting plate (66) which is associated with the aforementioned cut-outs (62) is provided for forward support.

5. A cross-country and touring ski binding for cross-country ski boots having a sole with a front end (16) with at least one pivot member extending crosswise to the longitudinal extension of the boot and approximately parallel to the sole surface adapted to be inserted in engagement with elements of the binding (10), said binding comprising a binding housing (14) of plastic material having a low wear resistant characteristic and having a pivot support unit for establishing a pivot-type connection with said pivot member (18), said pivot support unit includes a retaining hook (26) engaging the rearward side of said pivot member (18) and constituting a hinge joint therewith, said hook being movably mounted to said housing for movement between a closing position and releasing position, a resiliency deformable element (flexor 80) located for engaging the front end of the sole and resiliently urging the boot (12) from a raised position to a position approximately parallel to the ski, said binding housing having an open-topped recess (56) extending transversely to the longitudinal extension of the ski, a bearing member secured within said recess to releasably receive said pivot member, said retaining hook (26) includes a flat element (30) mounted for reciprocating displacement inside said binding housing (14) and having a first end (32) including a U-shaped bracket (34) opening forwardly towards the ski tip, said flat element located with a forward end of said hook engaging the back side of said sole-integrated pivot member (18) in the closed position of the binding, said hook having a rearward end, an actuating lever (38) pivotally supported for pivoting movement inside said binding housing (14), said actuating lever being constructed to establish a reciprocating translational movement of said retaining hook (26) in said housing.

6. The binding of claim 5, including a pivot unit connected to said actuating lever (38) and including a swivel arm (44) pivotally coupled to said retaining hook (26) and pivotally coupled to said actuating lever (38), with the hook and lever coupling axes (50, 52) located in spaced parallel relationship to each other.

7. The binding of claim 6, having a resilient element resiliently holding said retaining hook (26) in its closing position.

8. A cross-country and touring ski binding for cross-country ski boots having a sole with a front end (16) with at least one pivot member (18) extending crosswise to the longitudinal extension of the boot and approximately parallel to the sole surface adapted to be inserted in engagement with elements of the binding (10), said binding comprising a binding housing (14) of plastic material having a low wear resistant characteristic and having a pivot support unit for establishing a pivot-type connection with said pivot member (18), said pivot support unit includes a retaining hook (26) engaging the rearward side of said pivot member (18) and constituting a hinge joint therewith, said hook being movably mounted to said housing for movement between a closing position and releasing position, a resiliency deformable element (80) located for engaging the front end of the sole and resiliently urging the boot (12) from a raised position to a position approximately parallel to the ski, said binding housing having an open-topped recess (56) extending transversely to the longitudinal extension of the ski, said pivot support unit including a bearing member unit (60–68) formed of high wear resistant material secured within said recess to releasably receive said pivot member, wherein said retaining hook (26) has a rear end (32) including a U-shaped bracket (34) facing the forward end of said ski end, a guide element (72) for guiding said retaining hook (26) in the longitudinal direction of the ski, said guide element (72) including an upper roof overlying said bracket (34) and disposed for reciprocating movement within said binding housing (14), said guide element (72) in the closing position having a shape mating with the shape of said binding housing (14).

9. The binding of claim 8, wherein said hook (26) has a flat element connected to said binding housing and said guide element (72) includes a land (74) extending towards the rearward end of the ski and substantially as an extension of said flat element (30), said reciprocating movement of said land being located beneath said housing to minimize entering of foreign matter including snow and ice.

10. The binding of claim 9, wherein a groove (76) is formed substantially within the underside of said binding housing (14), and said land (74) is mounted within said groove for reciprocating movement.

11. A cross-country and touring ski binding for cross-country ski boots having a sole with a front end (16) with at least one pivot member (18) extending crosswise to the longitudinal extension of the boot and approximately parallel to the sole surface adapted to be inserted in engagement with elements of the binding (10), said binding comprising a binding housing (14) of plastic material having a low wear resistant characteristic and having a pivot support unit for establishing a pivot-type connection with said pivot member (18), said pivot support unit includes a retaining hook (26) engaging the rearward side of said pivot member (18) and constituting a hinge joint therewith, said hook being movably mounted to said housing for movement between a closing position and releasing position, a resiliency deformable element (80) located for engaging the front end of the sole and resiliently urging the boot (12) from a raised position to a position approximately parallel to the ski, said binding housing having an open-topped recess (56) extending transversely to the longitudinal extension of the ski, said pivot support unit including a bearing member unit (60–68) formed of high wear resistant material secured within said recess to releasably receive said pivot member, wherein said binding housing (14) comprises at least one guide fin (84) extending from the deformable element (80) towards the end front of the ski and adapted to complement and engage a guide groove (24) on the underside of the sole of the ski boot (12), wherein each said guide fin (84) is provided with at least one equidistantly spaced open-topped recess (86) extending crosswise to the longitudinal extension of the ski.

12. The binding according to claim 1, wherein said bearing unit (66, 68) and said retaining hook (26) are made of a non-corroding material.

* * * * *